United States Patent [19]

Newbrough

[11] 4,025,235

[45] May 24, 1977

[54] SYSTEM FOR IMPROVING OIL WELL PRODUCTION

[76] Inventor: Joseph S. Newbrough, 1869 Wedgemere, El Cajon, Calif. 92020

[22] Filed: Nov. 19, 1975

[21] Appl. No.: 633,370

[52] U.S. Cl. ..... 417/54; 417/172; 417/189

[51] Int. Cl.[2] ..... F04F 5/14

[58] Field of Search ..... 417/12, 53, 54, 55, 417/76, 87, 151, 172, 182, 189, 182.5, 108; 166/105, 314

[56] References Cited

UNITED STATES PATENTS

| | | | |
|---|---|---|---|
| 3,524,713 | 8/1970 | Osmon | 417/54 |
| 3,653,717 | 4/1972 | Rich et al. | 417/55 X |
| 3,718,407 | 2/1973 | Newbrough | 417/172 X |
| 3,797,968 | 3/1974 | Elfarr | 417/145 X |

*Primary Examiner*—William L. Freeh

*Assistant Examiner*—Edward Look

*Attorney, Agent, or Firm*—Brown & Martin

[57] ABSTRACT

A system utilizing intermittent build-up and bleeding of gas pressure in the annulus between the casing and tubing in an oil well with an inert gas interface between the gas and the producing fluid. The well is equipped with a down hole packer, inlet aperture above the packer through the tubing, and check valves above and below the packer and aperture. The system is sequentially operated by successively injecting the gas into the annulus forcing oil fluids through the aperture and up the tubing, and then bleeding the gas pressure, allowing the fluid to pass back into the annulus to the extent of the bottom hole pressure, while maintaining the necessary pressure on the formation. The cross section of the tubing is substantially smaller than the cross section of the annulus volume, thus a multiplying occurs in lifting the fluid in the tubing.

12 Claims, 4 Drawing Figures

SYSTEM FOR IMPROVING OIL WELL PRODUCTION

BACKGROUND OF THE INVENTION

The production of oil fluids from an oil well normally moves through a life cycle to a point where the well lacks sufficient reservoir energy to lift the oil well fluid to the surface. When this occurs in a shallow well, the oil fluid may be lifted to the surface by conventional means, such as pumps or the like. In deeper wells it is necessary to increase the reservoir energy by pressurizing the formation with inputs of gas or water under pressure. The gas normally has to be a gas similar to that from the formation to eliminate oxygen and thus possible combustion of oil-gas fluids.

Even though the bottom hole pressure of the oil producing formation is sufficient to lift the oil fluids to a substantial height in the casing or tubing, or even to the surface, the well cannot be produced unless the oil fluids are moved out of the top of the tubing. The alternatives of providing gas or water drives through the formation for producing oil fluids are expensive and often times raise the economic limit of the well to a point where well production is ceased and the well is capped at a relatively early stage.

The problem of oil fluid drive is particularly complex in deep wells, where it is both difficult to use repressurizing by gas or water fluids or the like, and where the well is too deep to pump.

It is therefore advantageous to have a system for moving oil well fluids from the level that the oil producing formation raises the oil fluids in the casing or tubing, to the surface for production, and by means that is relatively inexpensive thus reducing the economic plugging limit of the well.

SUMMARY OF THE INVENTION

In a preferred embodiment of this invention, gas, such as air, is pumped or injected into the annulus between the casing and tubing with a packer between the tubing and the casing at a given level below the normal well fluid or adjacent the bottom of the hole, but above the producing formation. An opening or aperture is placed through the tubing above the packer and a check valve is placed in the tubing below the packer. The gas under pressure moves down into the casing annulus forcing the oil fluids that have risen in the casing annulus due to bottom hole pressure, through the aperture and up through the tubing to the surface. The check valve and packer prevent exerting excessive pressure on the oil producing formation.

The tubing has a small cross sectional area relative to the cross sectional area of the annulus between the tubing and the casing. This difference in areas can be represented in a given number of multiples. So the gas pressure exerted on the fluid in the annulus is effective to move a multiple of fluid in the tubing.

An inert gas, such as $CO_2$, is injected as the gas in initial operation. The $CO_2$, being heavier than air, moves to the bottom of the annulus to provide the lift and provides an interface between the air and the oil well fluids and prevents explosions as well as other oxidizing problems.

The system uses at least one check valve installation at the lower end of the length of the tubing to hold oil fluids in the tubing while the system is recovering. It is then not necessary to lift the fluid in the tubing at the start of each cycle of operation. This maintains a desired weight pressure in the well at all times and reduces the time cycle of operation. This also decreases the power consumption required to cycle the system. In most wells, the time cycle for operation is not so critical as is the size, complexity and expense of the equipment required to lift the oil fluid to the surface.

A control system controls the cycle of operation. In this cyclic operation, the gas is pumped into the casing annulus until a given pressure exists. This pressure can be set either by the capacity of the pump, or by that required to lower the fluid in the annulus a desired amount. The fluid level is never lowered in the annulus to the tubing aperture. The movement of the fluid downwardly in the annulus moves the fluid from the annulus into the tubing, with reverse flow into the producing formation being prevented so the oil fluid rises to the surface in the tubing. After the induced fluid flow has ceased in the tubing, the gas pressure is bled off from the annulus. The $CO_2$ remains in the annulus as it is heavier than air. When the oil fluid has again risen to a steady state condition in the annulus and tubing, the operation is repeated. The time length between operations is determined by the time required for the formation to recover to a static oil fluid condition in the tubing and casing.

Thus the system provides an auxiliary lift of oil fluids to the surface by a relatively small pump installation, and from great depths. This allows many wells to be produced that would otherwise be capped.

It is therefore an object of the invention to provide a new and improved means for producing oil fluids from oil wells.

Other objects and many attendant advantages of this invention will become more apparent upon a reading of the following detailed description and an examination of the drawings, wherein like reference numerals identify like parts throughout and in which.

Figures 1, 2:
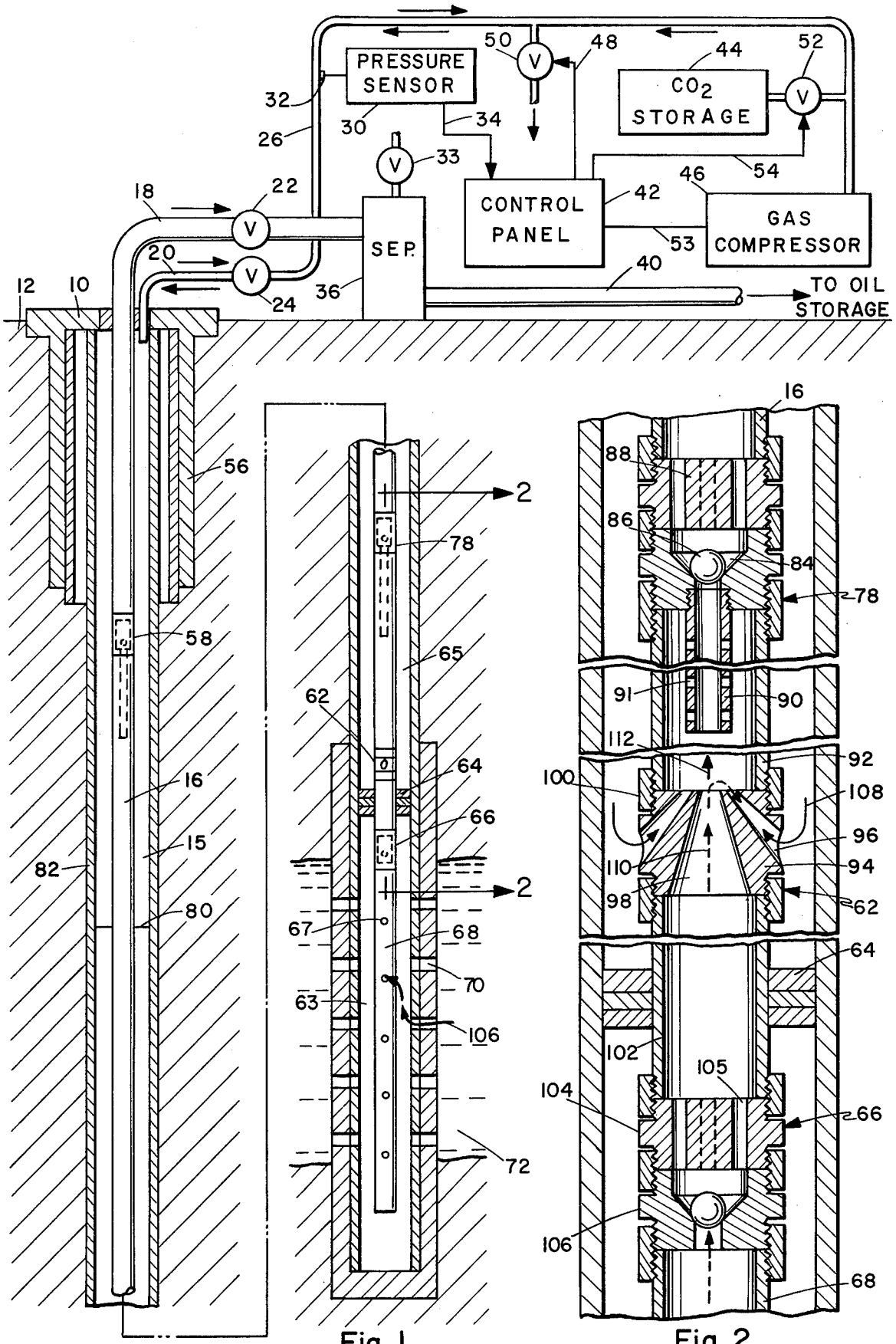
FIG. 1 is a block diagram embodiment of the surface equipment used in the invention, with a sectional view of the oil producing well, casing and tubing.
FIG. 2 is a sectional view taken along line 2—2 of FIG. 1.

Referring now to the drawings, the system of the invention operates on existing wells. Such an existing well may comprise a producing or former producing oil well having a casing 82 with an upper casing and well head structure 10 and 56 positioned in the ground 12. The casing has positioned therein, a tubing string 16 that extends into the producing formation 72. The lower end of the casing 82 is set into and below the formation 72. The casing is perforated with openings 70 so that the oil fluid can pass into the lower end of the casing. There the oil passes through holes 67 in the lower end of the tubing 68 and into the tubing. A bottom hole packer 64 seals the annulus, which is the space 15 between the casing 82 and the tubing 16, into a lower annulus portion 63 and an upper annulus portion 65. A check valve means 66 is positioned in the tubing below the packer 64 and comprises a seat 106 for the ball valve and a ball valve holder 104 that has a plurality of passages 105 therethrough. The fluid is thus able to pass in the direction of the dotted line, see FIG.

2, through the check valve and passages 105 and up into the volume 17 of the tubing 16.

Positioned above the packer 64 is an inlet aperture 62. This inlet aperture takes the form of a cylindrical unit having passages 96 therethrough. These passages can also be shaped in the form of tapered jet type passages. The center of the cylindrical member 94 has a conical passage 98 that allows the fluid to flow up into the tubing volume. When the annulus fluid is forced downward by the gas pressure, then the annulus fluid moves in the direction of arrows 108 into the tubing.

Collars 100 hold the cylindrical aperture member 62 in position in the tubing string. A second check valve means 72 is positioned above the aperture means 62, which check valve has a structure similar to that previously described relative to check valve 66, with a ball 86 fitting in a seat 84, and which valve is held in position by collars. The check valve 78 also has an extender 90 with apertures 91 to facilitate fluid passage into and through the check valve.

More than one check valve may be placed in the tubing string, such as check valve 58, for holding the fluid in the tubing during cyclic operation of the system.

Positioned on the surface is a tubular connection 18 that is connected to the tubing 16 and carries the fluid through a valve 22 to the separator tank 36. The oil is then normally separated from gas, water and other contaminates and is moved through line 40 to the oil storage tanks. Gas may be bled from the separator through valve 33. The annulus, in addition to being filled at its lower end by packer 64, is sealed at its upper end by a suitable plug member 60 through which pipe 20 passes. Pipe 20 is connected through valve 24 and pipe 26 to a gas compressor 46. Gas compressor 46 compresses gas such as gas from the well or air that is forced through line 26 and valve 24 into the upper annulus volume 15. First $CO_2$ is stored in storage tank 44 under pressure and is first fed through valve 52 into line 26 and through valve 24 and into annulus 15. The $CO_2$ is thus inserted under pressure of the $CO_2$ storage tank into the line as desired and controlled by control valve 52, that is controlled through control panel 42 and line 54. A bleed valve 50 bleeds the gas or air from line 26, or from the annulus 15 as controlled by valve 24, to the atmosphere at selective times and as controlled by the control panel 42 and line control 48. It may be understood that when gas from the well is used, this gas may be fed to a tank or the like, not shown, for later supply to the intake of gas compressor 46. A pressure sensor device 30 is responsive to a pressure sensing transducer 32 that is connected to and senses the line pressure in line 26. This sensor passes a signal when a certain pressure is sensed through line 34 to the control panel 42.

Figure 4:
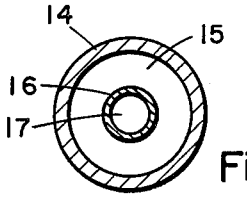
FIG. 4 is a sectional view taken along line 4—4 of FIG. 3.

It will be noted, see FIG. 4, that the cross sectional area of the tubing volume 17 is substantially smaller than the cross sectional area of the annulus volume 15.

Figure 3:
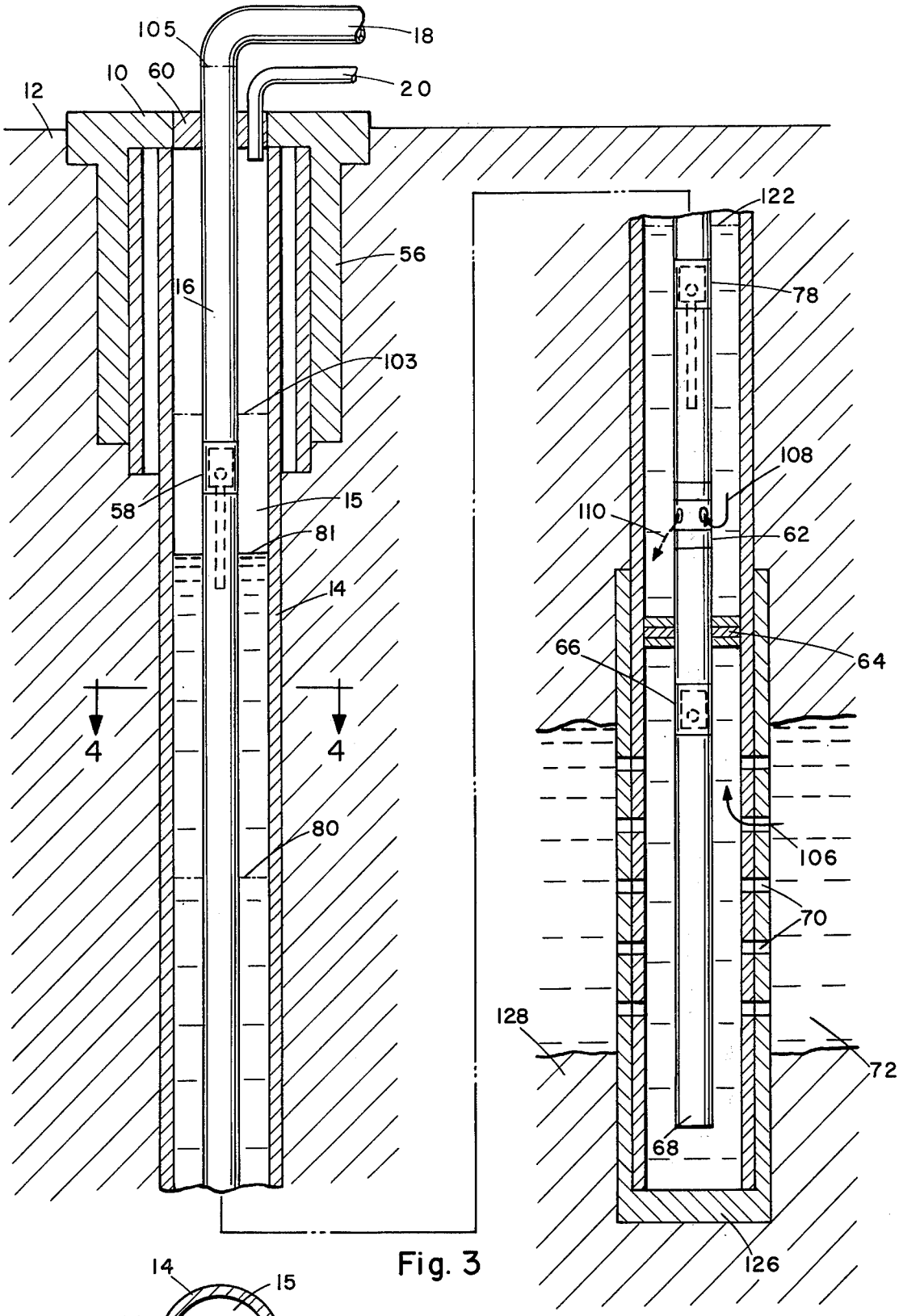
FIG. 3 is a sectional view illustrating the movement of the fluids during the system's operation.

In operation, valve 50 may be initially open, thus atmospheric pressure exists in the annulus 15 and the fluid has risen to the maximum height in the tubing and annulus. Also tubing 18 is open through normally opened valve 22 and the separator 36 to the atmosphere. Thus oil fluid passes through apertures 106 from the formation 72 and through holes 67 and through check valve 66 into the tubing 16 and through aperture means 62 in the direction of dotted arrow 110 into the upper annulus volume. The oil fluid thus rises in the annulus and tubing to the level determined by the force of the bottom hole pressure of the formation. This level, for example, may be any level such as levels 80 or 81, as illustrated in FIGS. 1 and 3. In this initial condition, the formation does not have sufficient energy to raise the oil well fluids to the surface and thus the oil well is not a flowing well. It may be in deep wells that the level 80 is so low that it is not possible to pump the well, even if this could be done economically. So the well would have to be produced, if possible, by raising the fluid 80 to the surface by increasing the energy in the formation by auxiliary means, such as by injecting gas or water into the formation at locations spaced from the producing well, and thus use the recycling gas or water to increase the reservoir energy to lift the fluid to the surface.

When the oil fluid level has risen sufficiently in the tubing and annulus, then the control panel 42 opens valve 52 and allows $CO_2$ to flow from the $CO_2$ storage tank 44 through line 26, valve 24 and line 20 into the annulus volume 15. The amount of $CO_2$ allowed to flow into the annulus volume 15 is generally that amount required to fill the annulus 15. This amount can be that previously calculated as required to fill the measured volume of the annulus 15. After the given amount of $CO_2$ gas has flowed into the upper annulus, valve 52 is closed by control 42 and the operation of the gas compressor 46 is initiated by a signal through line 53. The compressor 46 then compresses gas or air and injects the air through line 26, valve 24 and line 20 into the annulus 15. As this air or gas pressure increases, it increases the pressure on the oil level surface 81 forcing this oil in the annulus downwardly. This oil then flows from the annulus 15 through the aperture means 62 in the direction of arrow 108 into the volume of the tubing string 16, automatically closing check valve 66 and moving the oil fluid upwardly in tubing string 16. This oil fluid flow opens the respective check valves 78 and 58 and the oil fluid flows through tubing connection 18 and valve 22 into the separator tank 36.

This operation is continued until the pressure sensor 30 senses a given predetermined pressure magnitude, or the pressure sensor 30 detects that there has been no change in the maximum pressure for a period of time during operation. The latter would indicate that a pressure condition possible to be exerted by the air compressor 46 on the gas in the annulus 15 has been reached. The control panel in response to the pressure sensor signal through line 34 opens valve 50 slightly by a signal through line 48, slowly bleeding the air in annulus 15 to the atmosphere. The air or gas is bled off slowly so that the oil or well fluid rises gradually as the gas pressure decreases. This maintains the required fluid pressure on the formation through the annulus. The tubing is always maintained selectively full of fluid by the check valves, and sufficient to resist blow outs. It may be understood that normally only the air escapes to the atmosphere as the $CO_2$, being heavier than air, remains in the annulus. The $CO_2$ provides a buffer between the air and the oil well fluids or gas and thus prevents the occurrence of fires. It may be understood that the gas pressure magnitude is that required to lower the fluid level in the upper annulus to a predetermined level above the aperture meas 62, so that loss of $CO_2$ is minimized. The gradual increase in gas pressure in the upper annulus is necessary to compensate for the gradual lowering of the fluid level, with its weight, in the upper annulus. The particular pressures, depths and the like are measured and calculated for each individual well. The $CO_2$ gas buffer is maintained in position in normal operation, as the release of gas pressure on annulus 15 is gradually reduced as necessary.

When the pressure is sufficiently decreased in the annulus 15 and the oil fluid has flowed back through the tubing string 16 to a desired level, the check valves 58 and 78 close holding and suspending the oil fluid in the tubing string 16 to the level of about line 105. The fluid flows from the formation into the lower casing annulus, through check valve 66 and through aperture means 62 into the upper casing annulus 15. The time required for conditions to be achieved for the next cycle may be measured emperically or by calculation. The control panel has a suitable clock mechanism that is set to provide time cycle of operation that allows sufficient time for formation recovery.

It should be understood that is is only necessary that the fluid rise to a desired level to recycle the system. This would be when the fluid has risen sufficiently to make the operation practical. But it is not necessary to wait until a completely steady static condition has been reached.

The cross sectional area of the tubing 17 is substantially smaller than the cross sectional area of the annulus volume 15. So there is a multiplication of the upward movement velocity of the fluid in the tubing over that in the annulus. While it takes a longer period of time to fill the annulus that has a larger size and thus volume, this time is not normally a problem in the pumping of an oil well. It may be understood that where the ratio is 6 to 1 each foot of downward movement of the fluid in the annulus causes a movement of 6 feet of fluid in the tubing. Thus the amount of fluid produced each cycle is considerably greater than that in the tubing string at the start of operation.

Having described my invention, I now claim:

1. In a system for producing oil fluid from an oil well having casing and tubing positioned therein with an annulus space therebetween and with oil fluids moved by an oil producing formation to a given height in the casing annulus and tubing, comprising, packer means for sealing the upper annulus volume from a lower annulus volume at the oil producing formation, aperture means in the tubing above the packer means and below the normal oil fluid level in the annulus for passing oil fluids to and from the upper annulus volume to the tubing volume, check valve means in the tubing adjacent to or below the packer means for passing fluid from the formation to the tubing and annulus volumes and preventing reverse fluid flow, valving means for initially injecting a heavier than air, inert gas into the annulus, and then injecting a gas under pressure into the annulus volume against the layer of inert gas forcing the oil fluid therein downwardly in the annulus and through the aperture means into the tubing volume and upwardly in the tubing volume, means cooperating with said valving means for slowly releasing the gas pressure in said upper annulus volume allowing oil fluid to flow through said check valve means into said tubing and through said aperture means into said upper annulus volume with the heavier than air, inert gas thereon, control means for cyclically controlling the valving means in injecting the fluid under pressure into the upper annulus volume and opening said valving means and releasing said releasing means and the fluid under pressure, and said valving means responsive to said control means and having means for ceasing the injection of gas into the annulus before the oil fluid level in the annulus is lowered to said aperture means.

2. In the system claimed in claim 1 in which, the cross sectional area of the annulus volume is substantially larger than the cross sectional area of the tubing volume.

3. In the system claimed in claim 1 including, pressure sensor means for detecting the pressure in said upper annulus volume bleed valve means for bleeding the pressure in said upper annulus volume, and said control means having means responsive to said pressure sensor means detecting a given maximum pressure for opening said bleed valve means.

4. In the system claimed in claim 1 including, second check valve means positioned in said tubing for passing oil fluid upwardly to the upper end of said tubing and holding oil fluid from moving back through said tubing when the pressure is released in the upper annulus volume.

5. In the system claimed in claim 4 in which, said second check valve means including a plurality of check valves positioned in said tubing along the length thereof at spaced locations.

6. In the system claimed in claim 1 in which, said packer means is positioned just above the oil producing formation.

7. In the system claimed in claim 6 in which, said aperture means is positioned just above said packer means.

8. In the system claimed in claim 6 in which, said valving means is positioned at the upper end of said annulus adjacent the surface of the oil well.

9. In the system claimed in claim 8 in which, said injecting means including means for injecting fluid through said valving means.

10. The method of producing oil from an oil well having casing and tubing positioned therein with an annulus space therebetween and with oil fluids moved by an oil producing formation to a given height in the casing annulus and tubing, comprising the steps of:

sealing the upper annulus volume from the lower annulus volume at the oil producing formation, allowing oil fluids to move to and from the upper annulus volume to the tubing volume through apertures located above the point of sealing the annulus, passing fluid from the formation to the tubing volume and annulus volumes and preventing reverse fluid flow, selectively closing the upper annulus volume above the apertures forming the upper annulus volume, injecting a heavier than air, inert gas such as $CO_2$, initially into the upper annulus volume and then injecting a second gas under pressure into the upper annulus volume for forcing the oil fluid therein downwardly through said apertures into the tubing volume moving oil fluids upwardly in the tubing and out the upper end of the tubing while maintaining the layer of inert gas between the oil fluid and the second gas, gradually bleeding off the gas pressure in the upper annulus volume and allowing oil fluids to move upwardly into the upper annulus volume and into the tubing to the height determined by the oil producing formation bottom hole pressure while retaining the layer of inert gas, and cycling the operation by first injecting the gas under pressure and then releasing the gas and allowing the oil fluids to recover to the height in the upper annulus volume and then re-injecting the gas under pressure.

11. The method claimed in claim 10 including the step of, making the cross sectional area of the upper annulus volume substantially larger than the cross sectional area of the tubing volume.

12. The method as claimed in claim 10 including the steps of, sensing the pressure in the upper annulus volume, and when the pressure has reached a desired magnitude then bleeding the fluid pressure in the upper annulus volume.

* * * * *